US007442121B2

(12) United States Patent
Cassidy et al.

(10) Patent No.: US 7,442,121 B2
(45) Date of Patent: Oct. 28, 2008

(54) TEXTILE DUCTS

(75) Inventors: Stephen Cassidy, Portsmouth (GB); Brian Hunt, Portsmouth (GB); Niels Thomsen, Vejen (DK)

(73) Assignee: Wellman Defence Limited, Portsmouth, Hampshire (GB)

( * ) Notice: Subject to any disclaimer, the term of this patent is extended or adjusted under 35 U.S.C. 154(b) by 86 days.

(21) Appl. No.: 11/023,510

(22) Filed: Dec. 29, 2004

(65) Prior Publication Data

US 2006/0199501 A1 Sep. 7, 2006

(51) Int. Cl.
*F24F 7/04* (2006.01)
*F24F 13/02* (2006.01)
*F16L 11/02* (2006.01)

(52) U.S. Cl. ..... 454/306; 454/296; 454/903; 138/113; 138/114

(58) Field of Classification Search ..... 454/306, 454/228, 296, 903; 138/113, 114
See application file for complete search history.

(56) References Cited

U.S. PATENT DOCUMENTS 1,988,642 A * 1/1935 Wolbers ..... 165/129
2,089,492 A * 8/1937 Lambert ..... 138/149
2,401,974 A * 6/1946 Siebels ..... 285/55
2,572,062 A * 10/1951 Sexton ..... 137/594
2,804,095 A * 8/1957 Schauenburg ..... 138/107
2,960,924 A * 11/1960 Grott ..... 454/202
3,289,567 A * 12/1966 Renner ..... 454/172
3,363,591 A * 1/1968 Lawrence ..... 110/184
3,618,509 A * 11/1971 Nichols ..... 454/339
3,770,560 A * 11/1973 Elder et al. ..... 428/138
3,820,627 A 6/1974 Wirt
3,824,909 A * 7/1974 Horneff et al. ..... 454/187
3,916,991 A * 11/1975 Trump ..... 165/163
4,250,927 A * 2/1981 Newburg ..... 138/113
5,170,557 A * 12/1992 Rigsby ..... 29/890.08
5,329,972 A * 7/1994 Guiton ..... 138/103
5,670,756 A * 9/1997 Ohtaka et al. ..... 181/256
5,769,708 A * 6/1998 Paschke ..... 454/306
5,801,342 A * 9/1998 Hultberg et al. ..... 181/224

(Continued)

FOREIGN PATENT DOCUMENTS

DE 29821438 U1 4/1999

(Continued)

OTHER PUBLICATIONS

Rosenberg, Samuel H., ed. Ashrae Handbook—1984 Systems Volume. Atlanta: American Society of Heating, Refrigerating and Air-Conditioning Engineers, 1984, pp. 3.4-3.5.*

(Continued)

*Primary Examiner*—Steven B. McAllister
*Assistant Examiner*—Patrick F. O'Reilly, III
(74) *Attorney, Agent, or Firm*—Bacon & Thomas PLLC

(57) ABSTRACT

A textile duct for an air circulation system, the duct having an inner gas-permeable layer and an outer gas-impervious layer, and one or more spaces therebetween. An air circulation system having one or more ducts and one or more air treatment units and/or air handling units. The ducts are formed from laminates suitable for forming a duct for an air circulation system, the laminate has an inner gas-permeable layer and an outer gas-impervious layer, and one or more spaces therebetween.

38 Claims, 5 Drawing Sheets

U.S. PATENT DOCUMENTS

| | | | | | |
|---|---|---|---|---|---|
| 5,888,912 | A | * | 3/1999 | Piemonte | 442/60 |
| 6,062,270 | A | * | 5/2000 | Hultberg et al. | 138/129 |
| 6,234,163 | B1 | * | 5/2001 | Garrod | 126/80 |
| 6,234,211 | B1 | * | 5/2001 | Lepoutre | 138/114 |
| 6,565,430 | B2 | * | 5/2003 | Gebke | 454/306 |
| 2001/0017164 | A1 | | 8/2001 | Kouki et al. | |
| 2002/0162599 | A1 | * | 11/2002 | Aubourg | 138/149 |
| 2003/0082972 | A1 | * | 5/2003 | Monfalcone et al. | 442/138 |
| 2004/0029522 | A1 | | 2/2004 | Gebke | |

FOREIGN PATENT DOCUMENTS

| | | | | | |
|---|---|---|---|---|---|
| EP | 0 856 709 | A | | 8/1998 | |
| FR | 2 713 317 | A | | 6/1995 | |
| FR | WO 98/49486 | A1 | | 11/1998 | |
| GB | 1485988 | A | | 9/1997 | |
| JP | 03271652 | A | * | 12/1991 | |
| JP | 06221662 | A | * | 8/1994 | 454/254 |
| JP | 10205866 | A | | 8/1998 | |
| WO | WO 00/31455 | A | | 6/2000 | |

OTHER PUBLICATIONS

Attached English abstract for WO 00/31455 from Derwent Information Ltd.*

* cited by examiner

TEXTILE DUCTS

This invention relates to textile ducts for air circulation systems, including air conditioning systems.

Textile ducting (a system of ducts) has been used successfully for air-distribution systems in the commercial field for a number of years, but has only recently started to be used in the marine field. As such, since 1999, an increasing number of ships have been fitted with textile ducting as part of their air-distribution systems (air circulation systems).

Typically, the ducts are made of a gas-permeable material, in which case air passes through the weave of the material, or a material which is made to be gas-permeable by the introduction of slots or holes therein, for the passage of air.

As these materials are gas-permeable, they are only used at the point of dispensation and, therefore, air travelling from an air treatment unit and/or an air handling unit to a point of dispensation, travels through conventional aluminum ducting.

The use of textile ducting in this manner has shown a number of advantages. For example, noise is reduced at the point of dispensation by up to 9 decibels. Further, there is a noticeable reduction of draughts as well as more even air-distribution. By far the biggest advantage is the saving of weight, as textile ducts only weigh 20% of the weight of corresponding aluminum ducts, including the suspension system of the duct. As the air treatment units and/or air handling units are often located in compartments or rooms onboard ships or in buildings which are usually several compartments/rooms, or even several decks or floors from the point of dispensation compartment/room, it can be seen that, by replacing the aluminum ducts with a lighter-weight alternative, the weight savings could be very substantial. Of course, if conventional gas-permeable textile ducts were utilised instead of aluminum ducts, the ducting would lose a substantial amount of the air before the treated air reached the point of dispensation. It is possible to use ducting made of gas-impervious materials; however, such ducts have their own disadvantages. For example, often the ducting contains treated air at between 9° C. and 13° C. and the ducting is surrounded by air in a compartment/room, which can be at a temperature as high as 40° C. and 90% relative humidity. Typically, such gas-impervious ducting suffers from condensation forming on the outside of the ducting as the surfaces of the ducts cool to the temperature of the treated air. The air around the surfaces of the ducts, or in contact with the ducts, cools and drops below its dew point, which causes condensation to form on the outer surfaces of the ducts. Further, as it is likely that ducting is run through all areas of the ship, there would be an unacceptable risk of water dropping into critical electronic equipment. It is also particularly desirable to keep humidity to a minimum within the ship for the same reason. Thus, such gas-impervious ducting has not received widespread use.

There is, therefore, a need for light-weight ducting which can transfer air from air treatment or handling units to points of dispensation or distribution systems, without the loss of air through the ducts and/or condensation forming on the outer surfaces of the ducts.

The present invention aims to address at least some of the problems associated with the prior art.

Accordingly, in a first aspect the present invention provides a duct for an air circulation system, the duct comprising an inner gas-permeable layer and an outer gas-impervious layer, and one or more spaces therebetween.

Preferably, the duct further comprises spacing means, such as strips, tabs, meshes, webs, fibrous material and/or foams, located between the inner and outer layers. The spacing means may be provided in sealing contact with one or more respective surfaces of the inner layer and/or the outer layer.

Preferably, the inner layer and/or the outer layer is/are formed from a woven material.

The inner layer may be formed from a substantially gas-impervious material comprising one or more apertures.

Preferably, the outer layer is formed from a material comprising an aramid and/or a polyester, such as Traverna™, which is, most preferably, provided with a substantially non-porous weave.

Advantageously, the aramid is Nomex™.

The inner layer may be formed from a material comprising an aramid and/or a polyester, such as Traverna™, which is, preferably, provided with a porous weave. Also advantageously, the aramid is Nomex™.

It is envisaged that the inner and outer layers and the spacing means may be formed from other materials not specifically mentioned herein, but which materials are equally suitable. However, in the marine defence field, it is of particular importance to provide ducts which are fire-resistant and, therefore, only fire-resistant materials are suitable.

The duct may further comprise a fire-retardant. The fire retardant may be associated with the material forming the inner layer and/or the outer layer, and/or the one or more spaced between the inner layer and outer layers.

Advantageously, the depth of spacing between separate layers of the duct is provided by a predetermined relationship. The relationship depends upon at least one or more of the following factors: the proposed temperature differential between treated air and air surrounding the duct; the gas-permeable material; the permeability and/or density of the material; and the proposed flow rate of treated air within the duct. Typically, the depth of spacing between layers of the duct is from around 25 mm to 50 mm. Advantageously, the depth of spacing between the ducts is around 1 mm to 3 mm per degree of temperature differential, and most preferably 2 mm per degree of temperature differential. Preferably, the ducts of the present invention can have a substantially circular, D-shaped or quadrant cross-section, and may further comprise fastening means, most preferably, in the form of one or more zips.

The ducts may be provided with one or more additional gas-permeable layers interposed between the inner and outer layers.

In a second aspect of the present invention, there is provided an air circulation system comprising one or more ducts of the present invention, as defined herein.

In particular, the air circulation system is provided with one or more air treatment units and/or air handling units, wherein said one or more ducts provide(s) passages by which treated air can pass from the treatment and/or handling unit(s) to a point of dispensation. Preferably, the point of dispensation is provided with one or more air dispensation devices, wherein the one or more ducts provide(s) treated air to the one or more dispensation devices.

In use, the temperature of the treated air is below the temperature of air surrounding said one or more ducts. Preferably, the temperature of the treated air is from 5° C. to 18° C. and, most preferably, from 9° C. to 13° C. Advantageously, the air is treated by the air treatment and/or handling units to remove dust, particulates, moisture, and/or nuclear and/or chemical and/or biological agents.

In preferred alternatives, the air circulation system of the present invention may be provided: on a marine vessel, such as, a submarine or a ship; in a building; or in a vehicle, such as, a car.

The ducts of the present invention are formed from laminates. Accordingly, in a third aspect, the invention provides a laminate suitable for forming a duct for an air circulation system, the laminate comprising an inner gas-permeable layer and an outer gas-impervious layer, and one or more spaces therebetween.

Preferably, the laminate is provided with spacing means, such as strips, tabs, meshes, webs, fibrous material and/or foams, located between the inner and outer layers. The sealing means may be provided in sealing contact with one or more respective surfaces of the inner layer and/or the outer layer.

Preferably, the inner layer and/or the outer layer is/are formed from a woven material. Advantageously, the material of the inner layer and the outer layer is an aramid and/or polyester, such as Traverna™. Most preferably, the aramid is Nomex™.

As used herein, gas-permeable means a material that allows gas to pass through it. The manner in which the gas passes through the material may be by nature of the material itself, for example if the material is porous. This may be achieved using a woven material. Alternatively, the material may be substantially non-porous but provided with a plurality of apertures (e.g. holes or slots) through which gas can pass. Apertures may also be provided in gas-permeable materials which are naturally gas-permeable to make the material more permeable.

An air treatment unit, as used herein, may include one or more, and preferably all, of the following: a fan, a cooling coil, a heater, a moisture eliminator, and/or nuclear and/or biological and/or chemical agent filters. An air handling unit, as used herein, may include one or more, and preferably all, of the following: a fan, a cooling coil, a heater and/or a moisture eliminator. Typically, an air circulation system (air-distribution system) comprises one or more ducts, and/or one or more air treatment and/or handling units.

In order that the application may be more easily understood, embodiments of the invention are now disclosed, by way of example, in the accompanying drawings, in which.

Figure 1:
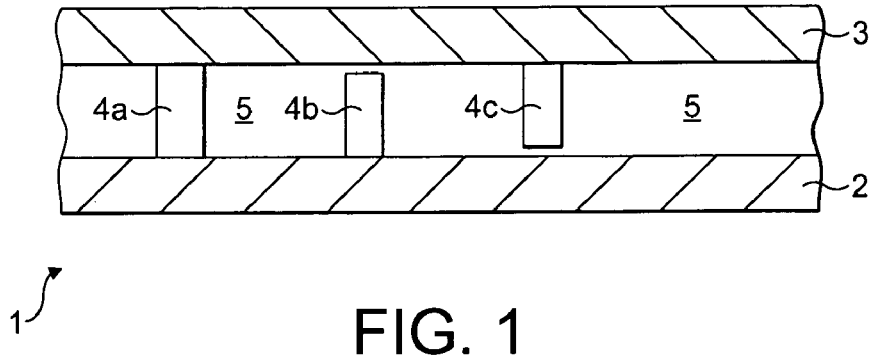
FIG. 1 is a cross-sectional view of a laminate of the present invention.

FIG. 1 shows a laminate, generally indicated at 1, having a gas-permeable layer 2, a gas-impervious layer 3 and one or more support strips 4*a*,4*b*,4*c* (spacing means).

Referring to all of the Figures, the gas-permeable layer 2 is made from a material comprising one or more aramids, such as, Nomex™, and is capable of allowing gas to pass through the material. The material is gas-permeable because it is provided with a loose, porous weave, i.e. gas can easily pass through the weave, or the material is provided with holes or slots 7, to allow gas to pass through the holes or slots, in an otherwise gas-impervious material.

The gas-impervious layer 3 is also made from a material comprising one or more aramids, such as Nomex™. This material substantially prevents any gas from passing through it, as it is provided with a tight, non-porous weave.

When the gas-permeable layer 2 and the gas-impervious layer 3 are brought into association to form the laminate, one or more spaces 5 therebetween are provided.

The one or more support strips 4*a*,4*b*,4*c*, are designed to aid separation of the gas-permeable and gas-impervious layers 2,3, so as to provide spaces 5 therebetween, preferably, of predetermined height. The support strips 4*a*,4*b*,4*c* can be provided in sealing contact with both the gas-permeable and gas-impervious layers 2,3, as shown by reference 4*a*, or in sealing contact with only one layer, either the gas-permeable layer 2 or the gas-impervious layer 3, as shown by references 4*b* and 4*c*, respectively. Preferably, the support strips are made from a material comprising an aramid, such as Nomex™ or a polyester such as Travera™.

Figure 2:
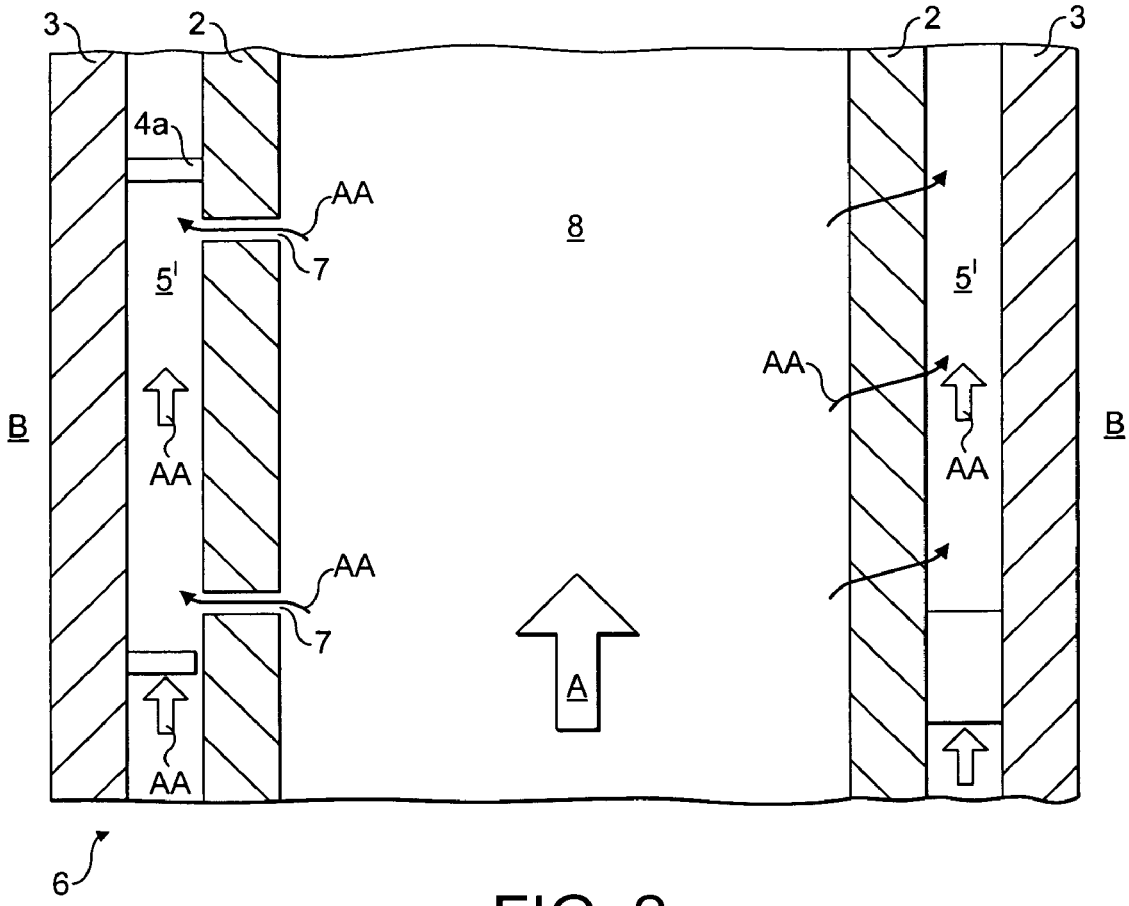
FIG. 2 is a cross-sectional view of the laminate of FIG. 1, in the form of a duct, the cross-section being shown along the length of the duct.

As shown in FIG. 2 in particular, the laminate 1, typically in the form of a sheet of laminate 1, can be formed into a duct 6 by sealing together a longitudinal edge of the laminate 1, most preferably, by sewing together the longitudinal edges. The duct is suitable for carrying a gas and, the gas-permeable layer 2 is provided as the innermost layer, and the gas-impervious layer 3, the outermost layer. Thus, a central space 8 is bounded by the gas-permeable layer 2—through which space 8 a bulk portion of gas can pass—and a further space 51 is bounded by the gas-impervious layer 3 and the gas-permeable layer 2—through which a smaller portion of gas can pass.

Figure 3:
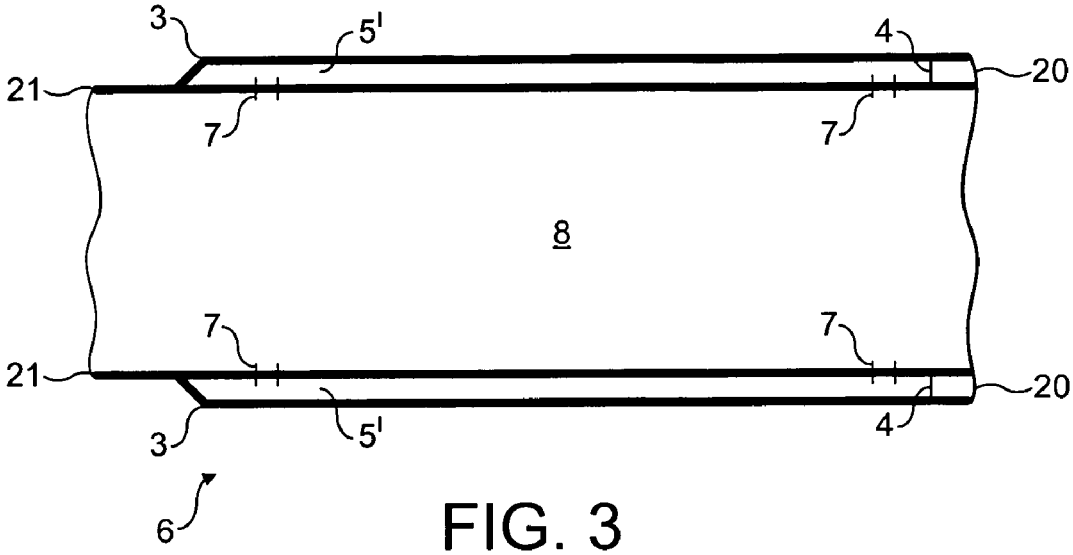
FIG. 3 shows a cross-sectional view of an end segment of duct of FIG. 2.
Figure 4:
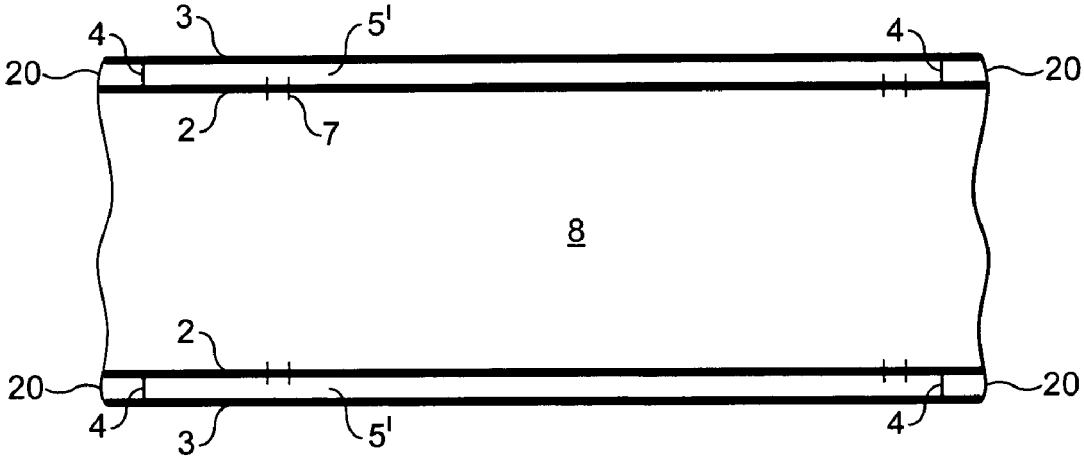
FIG. 4 shows a cross-sectional view of a centre segment of duct of FIG. 2.

Segments of duct 6 can be connected together. FIG. 3 shows and an end segment of duct 6 having an end 20, connectable to further ducts, and an end 21, connectable to air treatment and/or handling units. The ducts can be connected by a push-fit arrangement or any kind of fastening which provides a substantially gas-tight seal between the ducts, and/or air treatment and/or handling units. In a preferred example, segments of duct 6 are connected by zips. FIG. 4 shows a center segment of duct 6 which is provided with two ends 20 connectable to further ducts 6. Advantageously, end segments of duct 6 are fixed to aluminum end pieces (not shown) which are in turn connected to the air treatment and/or handling units.

Figure 5:
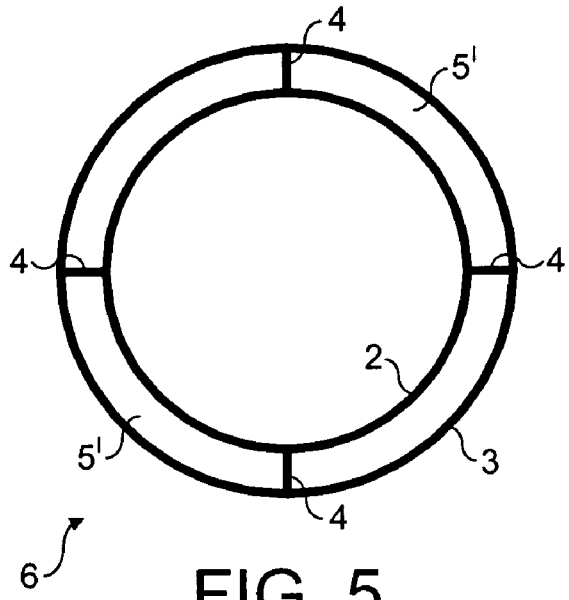
FIG. 5 is a cross-sectional view of an end of the duct of FIG. 2.

The ducts 6 of the present invention are easily installed and can be easily disassembled for cleaning, unlike prior art aluminium ducts. In particular, the ducts 6 can be washed in a washing machine, or similar, so as to free entrapped particles and dust, etc. from the weave of the material FIG. 5 shows an end-view of duct 6 of the present invention. The duct 6 is provided with four support strips 4, which aid separation of the gas-permeable and gas-impervious layers 2,3. Although four support strips 4 are shown, it is believed that, potentially, any number will do. However, two support strips are also preferred.

Figure 6:
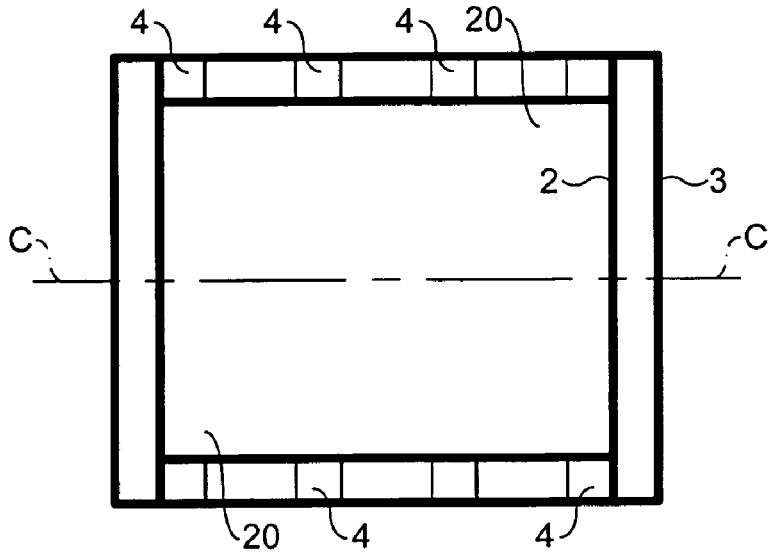
FIG. 6 shows a truncated longitudinal cross-section of a duct of FIG. 2.
Figure 9:
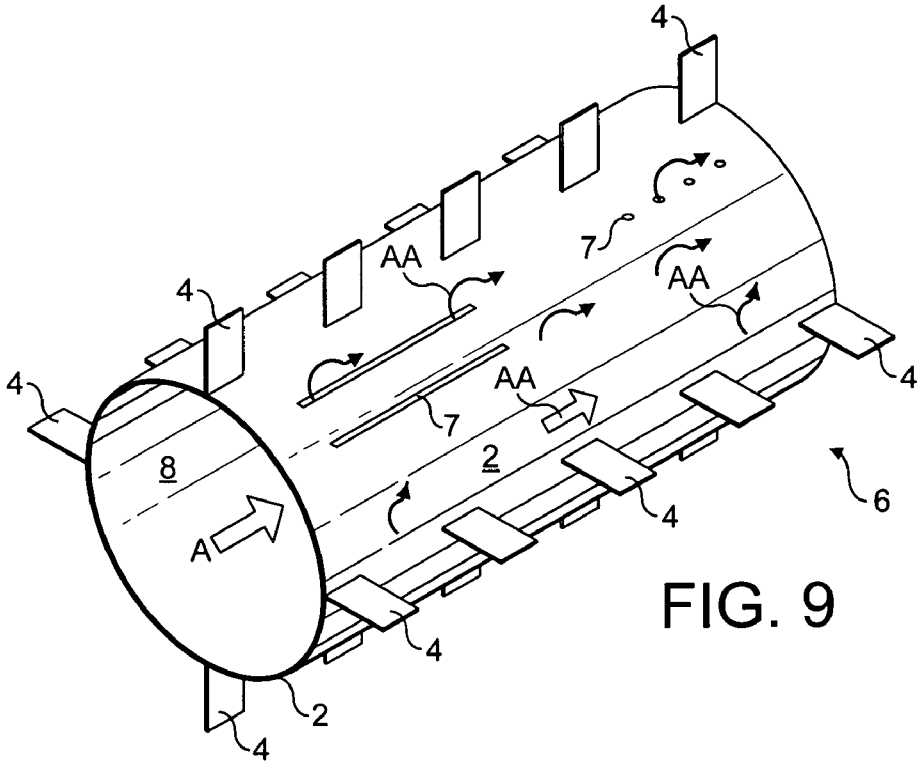
FIG. 9 is an isometric view of a transfer duct of FIG. 2 with the outer gas-impervious layer removed.

In FIG. 6, a longitudinal cross-section of duct is shown represented by the two ends of the duct 6 cut off from a central portion of duct along the Line C. At each end 20 of the duct are positioned four support strips 4. FIG. 9 shows an embodiment of an arrangement of support strips 4. As mentioned herein, spacing means can be arranged in any manner between the inner gas-permeable layer 2 and the outer gas-impervious layer 3, as long as the passage of gas AA through the space 5' is unhindered. It is further worth noting that the arrangement of spacing means 4 should not hinder the passage of gas AA through the inner gas-permeable layer 2. In this embodiment, four support strips 4 are provided equally spaced around the circular cross-section of the duct 6. Further, numerous support strips 4 are located in lines along the length of the duct 6. The support strips 4 are also arranged so that the smallest cross-sectional area of strip faces the flow of gas AA through the space 5', so that the flow of gas AA is substantially unhindered.

Figure 8:
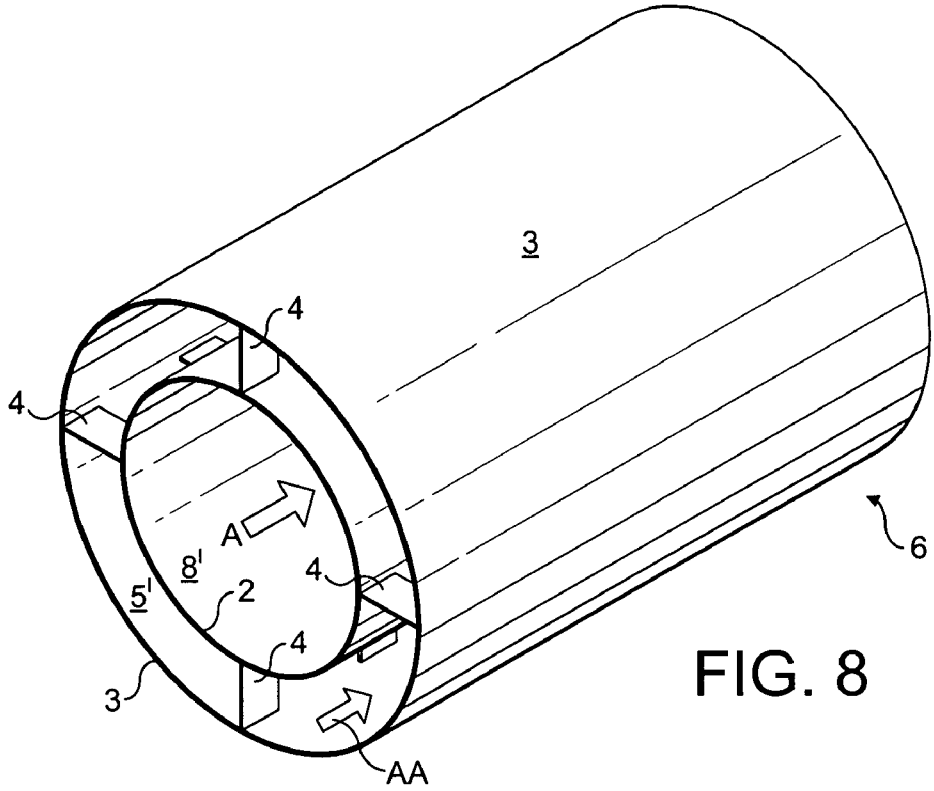
FIG. 8 is an isometric view of a transfer duct of FIG. 2.

In use, and as shown in FIGS. 2, 8 and 9, treated air, indicated by Arrow A, from an air treatment and/or handling unit is passed through the duct 6 in the direction of the arrow. The bulk portion of air A passes through the central space 8 of the duct 6 and on to further ducts, etc. A smaller portion of the air A, shown by Arrows AA, passes through, or has already passed through, the gas-permeable layer 2 into the space 5' and also flows on to further ducts, etc. Whilst it is not desired to be bound by theory, it is believed that condensation is substantially or totally prevented from forming on the outside of the duct 6 because of this arrangement. In particular, it is believed that, the temperature of the air AA in the space 5' is subjected to a heating affect, which is caused by the temperature of air surrounding the duct, shown by Letter B, being of a higher temperature than the air AA, and the air B heating the outer surface of the gas-impervious layer 3, which causes localised heating of air AA in the space 5' which is around the surface of the gas-impervious layer 3, or in contact therewith. Therefore, a temperature buffer layer is formed in the space 5', such that the temperature of the air AA is between the temperature of the treated air A and that of the air B surrounding the duct 6. Accordingly, the dew-point of air B around the surface of the duct 6, or in contact therewith, is not reached and condensation does not form on the outer surface of the duct 6.

Potentially, any supports or spacing means can be used, provided that the flow of gas through the spaces 5,5' are substantially unhindered. For example, meshes, tabs, semi-rigid foam or a fibrous filler material may be used between the gas-permeable and gas-impervious layers 2,3.

The duct 6 can be of any shape, but circular, square or D-shaped cross-sections are most preferred, as these shapes correspond to prior art ducts.

The aramid material which makes Nomex™ and the polyester which makes Travera™ are naturally fire-resistant. When alternative materials are used for the gas-permeable and/or gas-impervious layers, these materials may require the addition of a fire-retardant coating or additive.

Advantageously, the ducts of the present invention may be folded for storage and/or transport to the site of assembly.

In an alternative embodiment, the laminate and, therefore the duct, may be provided with a second or subsequent gas-permeable layer, provided that the outermost layer of the duct is the gas-impervious layer. By providing a further gas-permeable layer, the duct is provided with two temperature buffer layers, so that a greater temperature differential between the treated air and air surrounding the duct can be accommodated.

Figure 7:
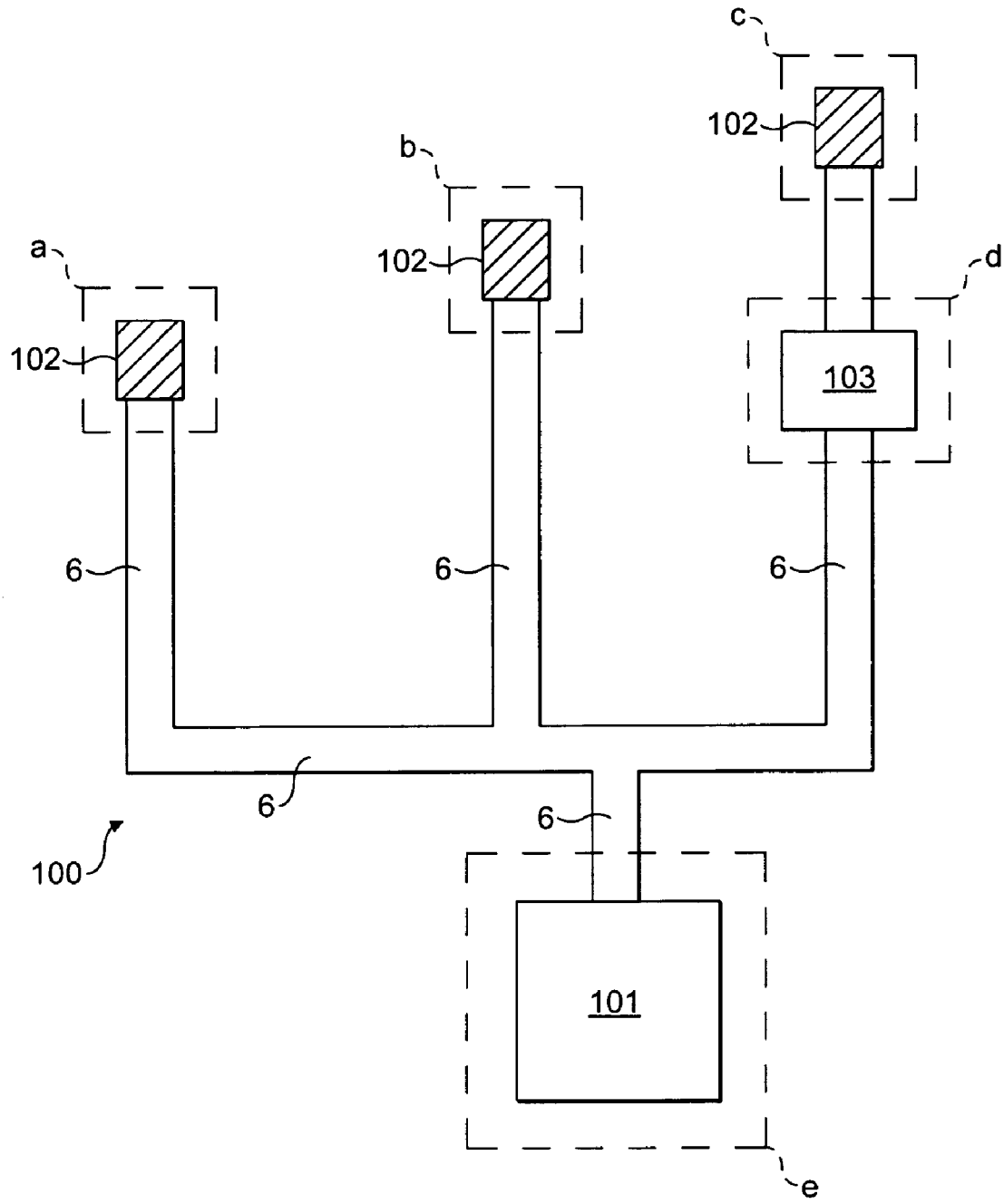
FIG. 7 shows a simplified air circulation system of the present invention.

FIG. 7 shows an air circulation system 100 in which an air treatment unit 101, situated in compartment e, provides treated air to a number of other compartments a, b, c, d, spaced apart from compartment e. Each of compartments a, b, c are provided with one or more prior art textile ducts 102 (dispensation devices), for example, a duct such as one known under the trade mark Texvent. Compartment d is provided with an air handling unit 103. Ducts 6 of the present invention run from the air treatment unit 101 to compartments a, b, d and also from compartment d to compartment c.

In use of the air circulation system 100, treated air from the air treatment unit 101 passes along ducts 6, of the present invention, to compartments a, b, c, d. During its passage, substantially no treated air is lost from the ducts 6 and substantially no condensation forms on the outside of the ducts 6. In compartments a, b, c the treated air passes into prior art textile ducts 102, from where the treated air can pass through the ducts 102 and provide treated air to the compartments.

Textile ducts and ducting of the present invention, and the claimed air circulation system, are believed to be particularly useful in air treatment and/or distribution systems for the marine field. In addition, it is conceivable that the claimed textile ducts may be used in both the commercial/building field and car/vehicle manufacture, as the technology of the ducts will be equally of use in those fields.

The invention claimed is:

1. An inflatable textile duct suitable for use in an air circulation system to transport a fluid whilst preventing condensation forming thereon, the duct comprising an inner gas-permeable layer and an outer gas-impervious layer formed from a material comprising a textile material, and spacing means located between the inner and outer layers so as to provide one or more inflatable unfilled spaces between the gas-permeable and gas-impervious layers, which unfilled spaces is/are capable of transporting a fluid in use, wherein the inner gas-permeable layer is provided with a porous weave which allows a fluid to pass through the inner gas-permeable layer.

2. A textile duct as claimed in claim 1, comprising along the length of the duct an inner gas-permeable layer and an outer gas-impervious layer.

3. A textile duct as claimed in claim 1, wherein the gas-permeable layer is a two-way gas permeable layer, allowing gas to pass in both directions through the gas-permeable layer.

4. A textile duct as claimed in claim 1, wherein the spacing means is/are formed from a material comprising a textile material.

5. A textile duct as claimed in claim 4, wherein the spacing means is/are selected from one or more of strips, tabs, meshes, webs, fibrous material and/or foams.

6. A textile duct as claimed in claim 4, wherein the spacing means is/are provided in sealing contact with one or more respective surfaces of the inner gas-permeable layer and/or the outer gas-impervious layer.

7. A textile duct as claimed in claim 1, wherein the inner gas-permeable layer and/or the outer gas-impervious layer is/are formed from a woven material.

8. A textile duct as claimed in claim 1, wherein the outer gas-impervious layer is formed from a material comprising an aramid and/or a polyester.

9. A textile duct as claimed in claim 8, wherein the material has a substantially non-porous weave.

10. A textile duct as claimed in claim 8, wherein the aramid is a meta-aramid fiber which is thermally protective and flame-retardant.

11. A textile duct as claimed in claim 1, wherein the inner gas-permeable layer is formed from a material comprising an aramid and/or a polyester.

12. A textile duct as claimed in claim 11, wherein the material has a porous weave.

13. A textile duct as claimed in claim 11, wherein the aramid is a meta-aramid fiber which is thermally protective and flame-retardant.

14. A textile duct as claimed in claim 1, and further comprising a fire-retardant.

15. A textile duct as claimed in claim 14, wherein the fire-retardant is associated with a material forming the inner gas-permeable layer and/or the outer gas-impervious layer, and/or the one or more spaces between the inner layer and outer layers.

16. A textile duct as claimed in claim 1, wherein the depth of spacing between the inner gas-permeable layer and the outer gas-impervious layer is provided by a predetermined relationship.

17. A textile duct as claimed in claim 16, wherein the depth of spacing between the inner gas-permeable layer and the outer gas-impervious layer of the duct depends upon one or more of the following factors: a proposed temperature differential between treated air and air surrounding the duct; a material of the inner gas-permeable layer; the permeability and/or density of said material; and the proposed flow rate of treated air within the duct.

18. A textile duct as claimed in claim 1, wherein the duct has a substantially circular, D-shaped or quadrant cross-section.

19. A textile duct as claimed in claim 1, and further comprising fastening means, for fastening together two or more ducts.

20. A textile duct as claimed in claim 1, comprising fastening means comprising one or more zips, for fastening together two or more ducts.

21. A textile duct as claimed in claim 1 further comprising one or more additional gas-permeable layers interposed between the inner and outer layers.

22. An air circulation system comprising one or more ducts as defined in claim 1.

23. An air circulation system as claimed in claim 22 comprising one or more air treatment units and/or air handling units, wherein said one or more ducts provide(s) passages by which treated air can pass from the treatment and/or handling unit(s) to a point of dispensation.

24. An air circulation system as claimed in claim 23 further comprising one or more air dispensation devices, wherein said one or more ducts provide(s) treated air to said one or more dispensation devices.

25. An air circulation system as claimed in claim 22, wherein, in use, the temperature of the treated air is below the temperature of air surrounding said one or more ducts.

26. An air circulation system as claimed in claim 22, wherein, in use, the temperature of the treated air is from 5° C. to 18° C.

27. An air circulation system as claimed in claim 22, wherein, in use, the temperature of the treated air is from 9° C. to 13° C.

28. An air circulation system as claimed in claim 22, wherein, in use, the air is treated by the air treatment and/or handling units to remove dust, particulates, moisture, and/or nuclear and/or biological and/or chemical agents.

29. An air circulation system as claimed in claim 22, wherein the air circulation system is provided on a marine vessel.

30. An air circulation system as claimed in claim 22, wherein the air circulation system is provided in a building.

31. An air circulation system as claimed in claim 22, wherein the air circulation system is provided in a vehicle.

32. A textile duct as claimed in claim 1, wherein the inner gas-permeable layer and the outer gas-impervious layer are formed from a material comprising a flexible material.

33. A flexible duct as claimed in claim 32, wherein the spacing means is/are formed from a material comprising a flexible material.

34. A textile duct as claimed in claim 1, wherein the inner gas-permeable layer and the outer gas-impervious layer are formed from one or more materials comprising a fire-resistant material or a fire-retardant material.

35. A duct as claimed in claim 34, wherein the spacing means is/are formed from one or more materials comprising a fire-resistant material or a fire-retardant material.

36. A textile duct as claimed in claim 1 further comprising a plurality of apertures in the inner gas-permeable layer to make the inner layer more permeable.

37. An inflatable textile laminate suitable for forming a textile duct, the textile laminate comprising an inner gas-permeable layer and an outer gas-impervious layer formed from a material comprising a textile material, and spacing means located between the inner and outer layers so as to provide one or more inflatable unfilled spaces between the gas-permeable and the gas-impervious layer, which spaces is/are capable of transporting a fluid in use, the inner gas-permeable layer is provided with a porous weave which allows a fluid to pass through the inner gas-permeable layer, wherein the laminate is formable in to a duct for transporting a fluid, whilst preventing condensation forming thereon.

38. A textile laminate as claimed in claim 37, wherein the laminate is formable in to a duct by sealing together a longitudinal edge of the textile laminate.

* * * * *